United States Patent [19]

Rossmanith

[11] 4,113,409

[45] Sep. 12, 1978

[54] HOSE PUMP WITH FRICTION DRIVE OF HOLLOW, RESILIENT ROLLER MEANS

[75] Inventor: Otto Rossmanith, Ottobrunn, Fed. Rep. of Germany

[73] Assignee: Messerschmitt-Bolkow-Blohm Gesellschaft mit Beschrankter Haftung, Munich, Fed. Rep. of Germany

[21] Appl. No.: 764,022

[22] Filed: Jan. 31, 1977

[30] Foreign Application Priority Data

Feb. 3, 1976 [DE] Fed. Rep. of Germany ..... 2604002

[51] Int. Cl.[2] ..... F04B 43/08; F04B 43/12; F04B 45/06

[52] U.S. Cl. ..... 417/477

[58] Field of Search ..... 417/477, 476, DIG. 1, 417/475; 418/45

[56] References Cited

U.S. PATENT DOCUMENTS

| | | | |
|---|---|---|---|
| 2,899,904 | 8/1959 | Becher | 417/477 |
| 3,216,362 | 11/1965 | Hewko | 417/477 |
| 3,358,609 | 12/1967 | Worth et al. | 417/477 |
| 3,366,071 | 1/1968 | Dutler | 417/477 |
| 3,816,035 | 6/1974 | Malbec | 417/477 |

FOREIGN PATENT DOCUMENTS

| | | | |
|---|---|---|---|
| 1,222,643 | 6/1960 | France | 417/477 |

*Primary Examiner*—Carlton R. Croyle
*Assistant Examiner*—Thomas I. Ross
*Attorney, Agent, or Firm*—Blanchard, Flynn, Thiel, Boutell & Tanis

[57] ABSTRACT

A hose pump comprising a housing having a cylindrical rolling surface therein and an annular groove which extends in the center of the rolling surface and is adapted to receive an elastic hose therein. A cylindrical drive member is arranged concentric with respect to the rolling surface and is connected to the housing through a fixed bearing. Pinch rollers are provided which roll along planetary-gearlike on the rolling surface and on a hose in the groove and are driven by the drive member sun-gearlike through frictional resistance. The pinch rollers are constructed as resilient and hollow cylinders.

4 Claims, 3 Drawing Figures

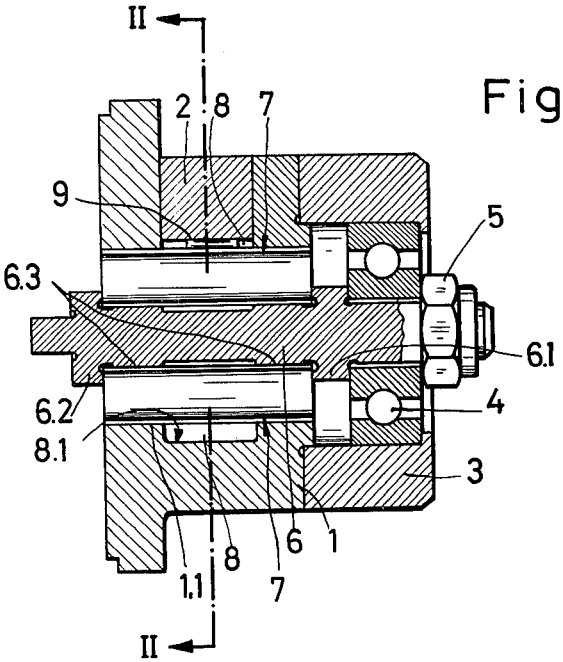
Fig.1
Fig. 2
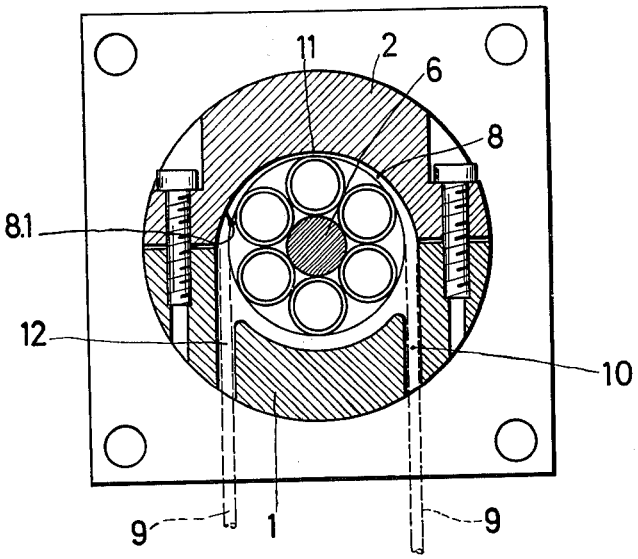

HOSE PUMP WITH FRICTION DRIVE OF HOLLOW, RESILIENT ROLLER MEANS

FIELD OF THE INVENTION

This invention relates to a hose pump comprising a housing, which has a cylindrical rolling surface, an eccentric groove which extends in the center of the rolling surface and adapted to receive an elastic hose therein, a cylindrical drive member arranged concentric with respect to the rolling surface and is connected to the housing through a fixed bearing and further comprising pinch rollers which roll along planetary-gearlike on the rolling surface and the hose and are driven by the drive member sun-gearlike through frictional resistance.

BACKGROUND OF THE INVENTION

Such a hose pump is described in German OS No. 2,140,872 published Feb. 22, 1973 and is used mainly for conveying of concrete. The efficiency of the pump and a damage of the conveying hose by stones present in the concrete are to be avoided in this hose pump by a special drive of the pinch rollers through frictional resistance and by providing an elastic outer layer on the pinch rollers for which purpose a complicated connecting bracket is used.

This connecting bracket is not absolutely needed particularly when using such a hose pump to convey liquids. It increases in this case merely the weight and the energy requirements of the entire pump. Compared with this, the drive of the pinch rollers through frictional resistance is particularly advantageous. On the one hand, the frictional force is, even at a high bearing force urging the pinch rollers against the rolling surface, very poor due to the pure rolling movement but, on the other hand, it permits an entirely jerk-free operation of the hose pump.

In the case of a rigid construction of the pinch rollers, the drive member and the rolling surfaces, a drive through frictional forces would require a high degree of manufacturing precision in the just mentioned structural parts. For this reason, the rigid pinch rollers of the known hose pump have an elastic outer layer which is provided to assure a frictional force between the drive member and the pinch rollers. However, such an elastic outer layer on the pinch rollers for transmission of the rolling movement from the drive member to the pinch rollers is of a disadvantage in many cases. In particular, when the hose pump stands still for a longer period of time, there exists the danger that the elastic outer layer is deformed by the constat pressure on the drive member, the rolling surface and the conveying hose or these parts adhere to one another or both occur together. Starting of the pump requires then particularly large forces which often can no longer be produced by the drive motors.

If the deformation does not disappear through the rolling movement, a constat jerklike conveying of the conveyed medium, an increased energy consumption and a strong stress on the conveying hose will take place.

Therefore, the purpose of the invention is to simplify the design of a hose pump pinch rollers driven by frictional resistance and to increase their reliability, in particular for an unsupervised long-time operation with stand still phases.

This purpose is attained intentively by the pinch rollers being constructed as resilient hollow cylinders.

It is of a particular advantage if the pinch rollers are made of a hard-elastic material, in particular of spring steel and if the outer diameter of the pinch rollers is greater than the radial spacing between the rolling surfaces of the housing and the drive member.

The inventively constructed pinch rollers are no longer flattened, as this is the case in known pinch rollers, at the contact points with the drive member and the rolling surfaces, but are almost of a circular or elliptic shape. The angles which are enclosed at the contact points between the pinch rollers and the rolling surfaces are consequently substantially smaller (near zero) in the case of the inventive pinch rollers than in the known design. The starting forces of the inventive hose pump are correspondingly small. The pressure which is needed for the frictional resistance between the driving and the driven parts is not affected, as exists with a soft, elastic outer layer on the pinch rollers, through the inventive design of the pinch rollers as resilient hollow cylinders. The pinch rollers may therefore be made of a very hard material, as for example spring steel so that the portion of the driving energy, which portion is consumed otherwise by the pressing operation in the elastic material, can be saved. Such materials have additionally the advantage that they, even after longer stand still time for the hose pump, do not permanently deform or adhere to the contacting parts.

The pinch rollers can, depending on the size of the hose pump and depending on the required number of the pinch rollers, be distributed either in close arrangement or separated from one another by a cage enclosing same around the drive member.

In particular, if a cage is not needed, it is advantageous if the drive member has two flanges which center the pinch rollers and limit their axial movability from both sides.

In order to utilize as much as possible the advantages for a jerk-free, even conveying output from the hose pump, which advantages are caused by the inventive construction of the pinch rollers, it is particularly advantageous if the inner wall of the annular groove is eccentric with respect to the rolling surface. The conveying hose is then not suddenly squeezed or released upon engagement with or release of the pinch rollers; these operations pass continuously over into one another in such a further development of the inventive hose pump so that periodic variations of the conveyor output can hardly be observed any longer. This can be of importance for a precise measuring in particular by using the hose pump for physical, chemical, medical or biological experimemnts — for example electrophoretic separating methods. To a particular (special degree) degree this is true for the use of such pumps in space flight experiments.

BRIEF DESCRIPTION OF THE DRAWINGS

The drawings which will be described hereinafter illustrate two exemplary embodiments of the subject matter of the invention.

In the drawings:

FIG. 1 is a longitudinal cross-sectional view of a hose pump;

FIG. 2 is a sectional view taken along the line II—II of FIG. 1;

DETAILED DESCRIPTION

Figure 3:
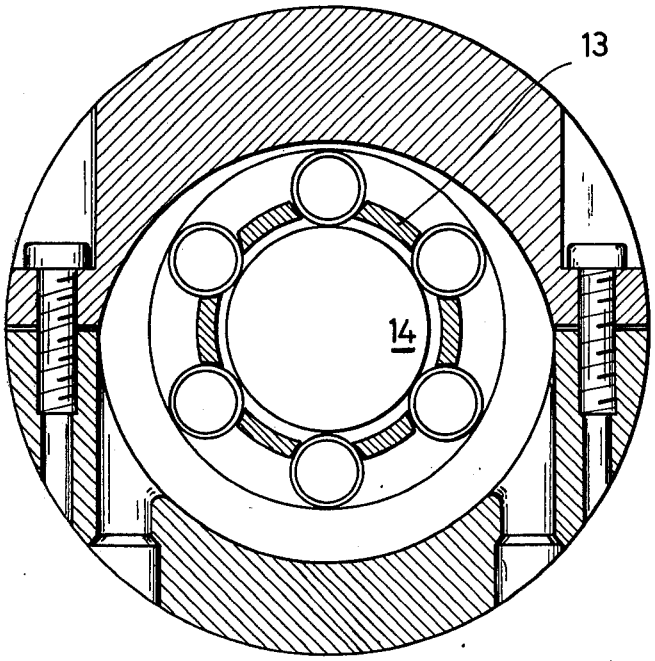
FIG. 3 is a sectional view similar to FIG. 2 but of a modified construction wherein the pinch rollers are guided in a cage.

The hose pump which is illustrated in FIG. 1 consists of a diametically split, two-part pump housing 1,2 connected together by bolts and a bearing housing 3 which is connected to the axial end of the pump housing. The bearing housing 3 supports the outer race of a ball bearing assembly 4, the inner race of which is secured by means of a threaded connection 5 to a shaft 6. The shaft 6 serves as a drive member and is driven by a not illustrated motor. Through this construction, the shaft 6 is fixed both in the radial and also in the axial direction. In the space between the rolling surface 1.1 of the pump housing 1 and the rolling surface 6.3 of the shaft 6, there are arranged a plurality of pinch rollers 7 similar to the rollers of a roller bearing. As can particularly be seen from FIG. 2, the pinch rollers 7 are constructed as hollow cylinders. The pinch rollers 7 lie closely together and are not surrounded by a cage. The pinch rollers are secured against axial movement relative to the shaft 6 by only two flanges 6.1 and 6.2 on the shaft. The flanges 6.1 and 6.2 act only on that part of the pinch roller 7 that is adjacent and engage or face the shaft 6 to effect an independent axial centering of the pinch rollers. The outer diameter of a loose pinch roller is slightly larger than the radial spacing between the rolling surface 1.1 of the pump housing and the rolling surface 6.3 of the shaft 6 so that the pinch rollers exert, in the installed condition, an initial stress or pretension onto the rolling surfaces 1.1 and 6.3. Through this construction, frictional forces effect a perfect transmission of rotary motion of the shaft 6 to the pinch rollers 7 and the pinch rollers are elastically compressed to an oval shape.

A conveying hose 9, which is preferably made of a soft-elastic material, lies in an annular groove 8 in the center of the pump housing, particularly in the center of the rolling surface 1.1. As can be seen from FIG. 2, the radially outer surface of the 8.1 of the groove 8 extends eccentrically with respect to the shaft 6. This causes the depth of the groove to be slowly reduced from the hose inlet 10 to the center 11 of the conveyor path and thereafter enlarged up to the hose outlet 12; through this type of construction, the conveying hose 9 is continuously compressed and again opened by the pinch rollers 7 moving relative thereto. The exact minimum depth of the radially outer surface of the groove at point 11 can be adjusted by a suitable dimensioning of the housing part 2. By removing the housing part 2, the conveying hose 9 can be easily placed into the pump and can be removed therefrom.

The hose pump which is illustrated in FIG. 3 is designed similarly to the hose pump illustrated in FIGS. 1 and 2. The pinch rollers 7 are, however, surrounded by a cage 13 through which they are fixedly spaced from each other a pregiven distance on the periphery of the drive member 14.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A hose pump, comprising:

a housing having a chamber therein and a pair of axially spaced first rolling surfaces in said chamber;

a hose receiving arcuate groove having an inlet and an outlet, the axial center of said groove being located equidistant from said first rolling surfaces, the depth of said groove being less toward the radial center of said arc than at said inlet and outlet thereof;

a shaft and means supporting said shaft for rotation, said shaft having axially spaced flanges thereon located symmetrical with respect to and axially outside of said first rolling surfaces, said shaft further having a pair of axially spaced second rolling surfaces radially aligned with and spaced radially inwardly from said first rolling surfaces and having a radial dimension less than said flanges; and a plurality of hollow, rigid cylindrical pinch rollers positioned around said shaft and between said flanges and held by said flanges against axial movement with respect thereto, said pinch rollers having an elastically deformable characteristic and having a diameter greater than said radial spacing between said first and second rolling surfaces whereby said pinch rollers are elastically compressed to an oval shape between said first and second rolling surfaces to thereby enhance a frictional rotary drive from said rotatable shaft to said pinch rollers and are free of engagement with said shaft between said second rolling surfaces.

2. The improved hose pump according to claim 1, wherein said plurality of pinch rollers are manufactured of a hard-elastic spring steel material.

3. The improved hose pump according to claim 1, wherein said plurality of pinch rollers are circumferentially spaced in close arrangement around said shaft.

4. The improved hose pump according to claim 1, wherein said pinch rollers are circumferentially spaced in a cage enclosing said pinch rollers separate from one another around said shaft.

* * * * *